US005540509A

United States Patent [19]

Matsuzawa et al.

[11] Patent Number: 5,540,509

[45] Date of Patent: Jul. 30, 1996

[54] COLOR PRINTER WITH EXCHANGEABLE RIBBON CASSETTES

[75] Inventors: Nobuyoshi Matsuzawa; Hideo Kawahara, both of Iruma, Japan

[73] Assignee: Ye Data, Inc., Saitama-ken, Japan

[21] Appl. No.: 235,810

[22] Filed: Apr. 29, 1994

[51] Int. Cl.[6] ..... B41J 33/00; B41J 29/00

[52] U.S. Cl. ..... 400/206; 400/692; 400/231

[58] Field of Search ..... 400/206, 206.2, 400/208, 231, 692

[56] References Cited

U.S. PATENT DOCUMENTS 4,809,018 2/1989 Nakamura et al. ..... 400/692

FOREIGN PATENT DOCUMENTS 5-116358 5/1993 Japan .
5-35291 5/1993 Japan .
5-93841 12/1993 Japan .
6-24112 2/1994 Japan .

*Primary Examiner*—David A. Wiecking
*Attorney, Agent, or Firm*—Wenderoth, Lind & Ponack

[57] ABSTRACT

A print unit provided with one or a multi-serial heads having a plurality of print pins widely arranged in a direction of the feeding of paper and is provided laterally movably on a guide shaft. A cassette holder having a plurality of monochromatic ribbon cassettes that are juxtaposed and received therein is arranged in parallel with and close to the moving path of the print unit. A suitable one of the monochromatic ribbon cassettes is transferred, in response to a control signal, from the cassette holder to the print unit, and from the print unit to the cassette holder.

11 Claims, 9 Drawing Sheets

COLOR PRINTER WITH EXCHANGEABLE RIBBON CASSETTES

BACKGROUND OF THE INVENTION AND PRIOR ART

The present invention relates to a color printer which can perform multi-color printing as well as monochromatic printing, particularly printing of computer graphics, and a color printer having a ribbon control device mounted thereon to enable economic use of a ribbon in the color printer.

As a printer capable of printing a plurality of colors, there is a serial type transfer printer using a multi-color ribbon in which a plurality of colors, for example Y, M and C, are successively coated with a length of one line print for each color on a single ribbon A as shown in FIG. 1. H denotes a head, and P denotes a continuous sheet of paper.

In the above-described serial type thermal transfer printer, ordinarily, three colors, yellow, magenta and cyan, are used. One line printing is performed with these colors, and printing of seven colors including a gathering coating is performed.

This conventional color printer has a disadvantage in that when a plurality of colors are separately coated, not only an unnecessary color portion is wasted, but also when other colors are printed, it takes much winding time.

Further, a special ink coating device is necessary to manufacture a multi-color ribbon. Therefore, there is often a limitation in procuring a multi-color ribbon.

Moreover, the conventional color printer has a problem in that it is difficult to put the printing of computer graphics to practical use.

SUMMARY OF THE INVENTION

It is an object of the present invention to provide a color printer which enables printing of color computer graphics and uses an inexpensive monochromatic ribbon without using an uneconomical multi-color ribbon to enable economical color printing.

For achieving the aforementioned object, a first embodiment provides a color printer comprising a print unit provided with one or a multi-serial head having a plurality of print pins widely arranged in a direction of feeding paper. A means is provided for laterally moving the print unit. A cassette holder receives therein a plurality of monochromatic ribbon cassettes in parallel with and close to a moving path of the print unit, the print unit being provided with a ribbon cassette receiving portion. A means is further provided for mutually transferring, in response to a control signal, the monochromatic ribbon cassette from the cassette holder to the print unit and from the print unit to the cassette holder.

A second embodiment provides the color printer with means for stopping, when a print signal is not present, a feed of a ribbon and quickly feeding the print unit to a next printing.

A third embodiment relates to a ribbon control device for stopping feed of a ribbon and provides a color printer with a ribbon control device comprising a memory and a control circuit therefor for equally dividing one scan portion of a serial head, by a column address bit, for raster scan image data transmitted from a host computer or hardware for controlling print data to provide a signal in suitable memory block unit. A register or a memory circuit detects and holds the presence or absence of a dot to be printed having a received data width for every signal of the control circuit when data is received. A means discriminates the presence or absence of data of the register or the memory circuit when a serial head is scanned according to a print signal, whereby when data is present, a ribbon is fed, and when data is not present, the ribbon is stopped.

A fourth invention provides a color printer comprising a print unit provided with one or a multi-serial head having a plurality of print pins widely arranged in a direction of feeding paper, a means for laterally moving the print unit, a cassette holder for receiving therein a plurality of monochromatic ribbon cassette in parallel with and close to a moving path of the print unit, the print unit being provided with a ribbon cassette receiving portion, and a means for mutually transferring, in response to a control signal, the monochromatic ribbon cassette from the cassette holder to the print unit and from the print unit to the cassette holder, and further comprising a means for suppressing or holding a paper end on the print start side in a moving direction of the head.

Finally, a fifth invention provides a color printer comprising a print unit provided with one or a multi-serial head having a plurality of print pins widely arranged in a direction of feeding paper, a means for laterally moving said print unit, a cassette holder for receiving therein a plurality of monochromatic ribbon cassette in parallel with and close to a moving path of the print unit, the print unit being provided with a ribbon cassette receiving portion, and a means for mutually transferring, in response to a control signal, the monochromatic ribbon cassette from the cassette holder to the print unit and from the print unit to the cassette holder, and further comprising a roller provided in the vicinity of the thermal head to pressure-contact with and retreat from paper simultaneously with the head.

In the color printer in accordance with the present invention as described above, the designated monochromatic ribbon cassette is transferred from the cassette holder to the print unit and mounted. After this, the print unit is moved laterally to perform printing with that color as if the print unit sweeps with a brush. Thereafter, the cassette of the print unit is returned to an original position of the cassette holder, the next cassette with a designated color ribbon received therein is transferred from the holder to the print unit and mounted, the same line is printed with that color, and the cassette is again returned to the cassette holder.

In this manner, printing is successively performed with designated colors. When printing of all colors for one line is completed, paper is fed to effect a next printing in a similar manner. Thereafter, the above-described operation is repeated to complete printing for all colors.

When a print signal is not present during the printing, the feed of a ribbon is stopped, and quick feeding is effected for a next printing position.

The fourth and fifth embodiments are provided so that when a thermal head is used as a printing head, paper is prevented from being dragged in the moving direction of the head by the head which moves in a state where it is pressed against paper during the printing.

DESCRIPTION OF THE PREFERRED EMBODIMENTS

Figure 1:
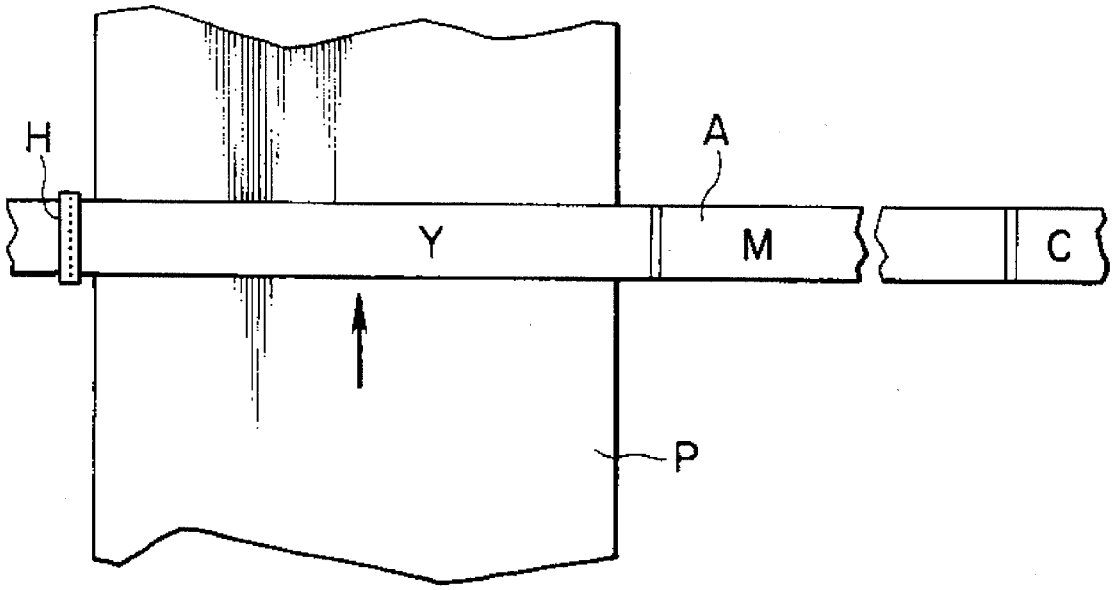
FIG. 1 PRIOR ART
FIG. 1 is an explanatory view of a conventional serial color printer.
Figure 2:
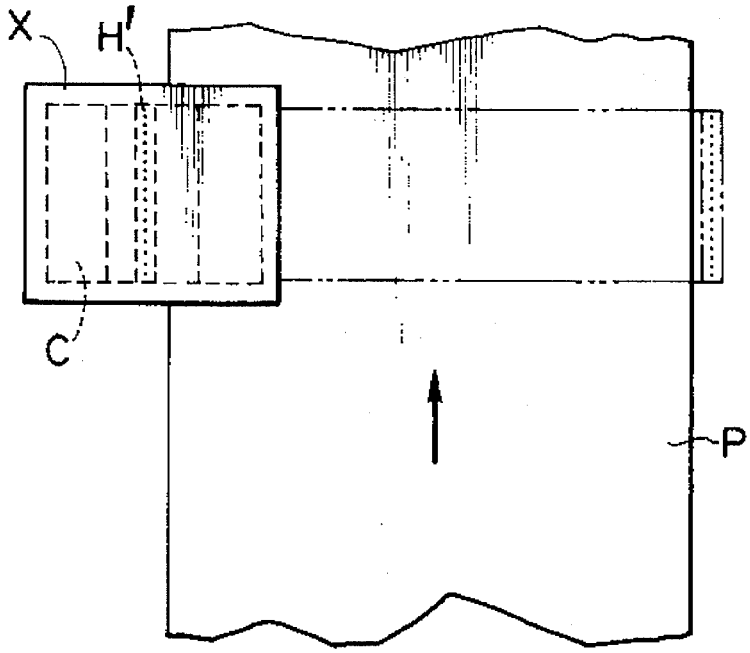
FIG. 2 is a view showing the principle of a printing system according to the present invention.

FIG. 2 shows the principle of a printing system according to the present invention. Color printing is performed by a printing method similar to multi-color printing, in which a print unit X provided with one or a multi-serial head H', having a plurality of print pins widely arranged in a feeding direction of paper P, is moved laterally in a direction widthwise of paper P along with a monochromatic ribbon cassette C. Printing is performed with that color as if the print unit sweeps with a brush, and the ribbon cassette is replaced with a ribbon cassette of a separate color in order to gathering-print the same place (line).

Figure 3A:
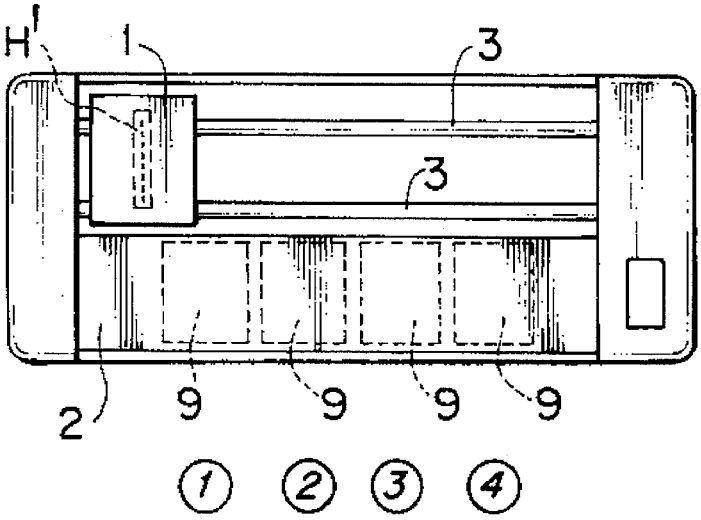
FIG. 3A is a plan view of a printer according to an embodiment of the present invention.
Figure 3B:
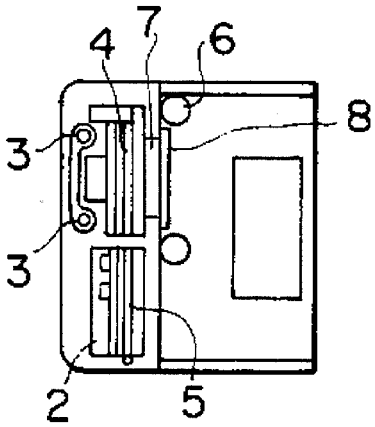
FIG. 3B is a sectional view of a printer according to an embodiment of the present invention.

The present invention is based on the above-described principle. FIG. 3A is a plan view of an embodiment in which the present invention is applied to a thermal color printer, and FIG. 3B is a sectional view thereof. In the drawings, reference numeral 1 designates a print unit provided with a thermal head 7. The print unit is suspended on two guide shafts 3 so as to be slidable and is laterally moved through a wire by a motor provided within a column of the main body (not shown). For the sake of convenience of the explanation, description is made of the case where the invention is applied to a thermal color printer using a thermal head having a plurality of print pins, but it is to be noted that the invention can also be applied to a dot impact color printer using a dot impact head. Thus the invention is applicable to a serial printing head of both the dot impact type and the thermal type.

A platen 8 is placed under the print unit 1 and parallel with the guide shaft 3, and paper feed rollers 6 are arranged on opposite sides of the platen 8. A cassette holder 2 is installed opposite to the print unit 1. FIG. 3B shows a positional relationship between the print unit and the cassette holder. A height position of a cassette support shaft 4 provided on the print unit 1 is at the same level as that of a cassette support shaft 5 provided on the cassette holder 2.

Figure 4:
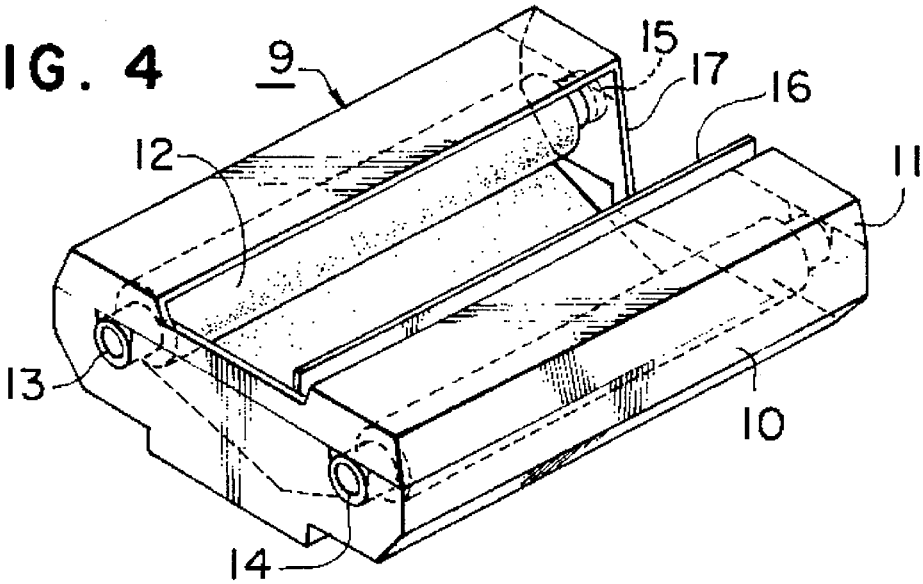
FIG. 4 is a perspective view of a ribbon cassette according to an embodiment of the present invention.

FIG. 4 shows a ribbon cassette 9 in this embodiment. The ribbon cassette 9 comprises a lower case 10 and an upper case 11, and an ink ribbon 12 wound about hollow cores 13 and 14 is put therein. A protrusion 15, to which winding power is connected, is provided on the end of one winding core 13. A shield plate 16 for detecting a cassette position is provided on the ribbon cassette 9. Further, a cut portion 17 is provided to avoid interference with the head when the ribbon cassette is moved.

Figure 5:
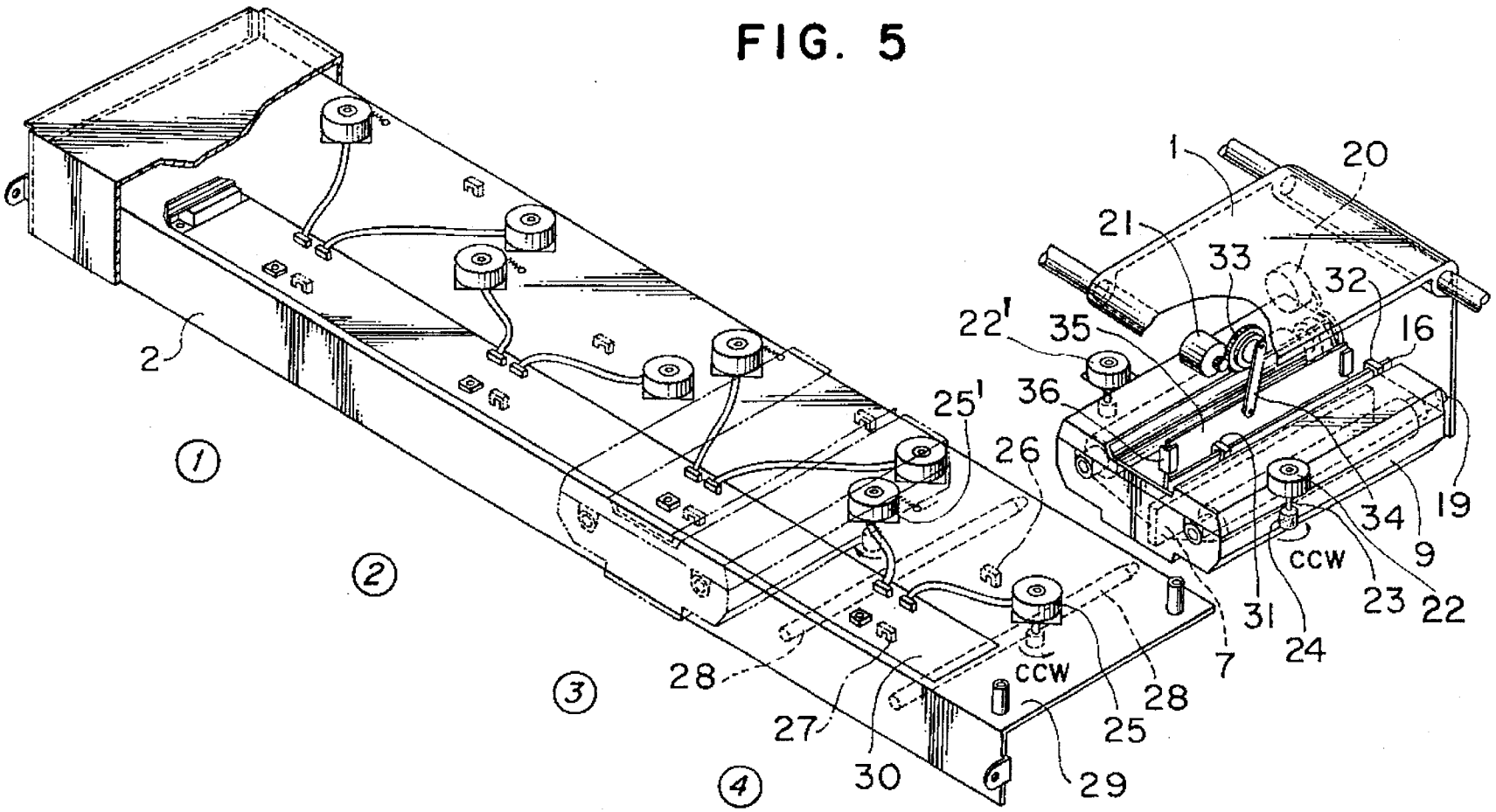
FIG. 5 is a perspective view of a print unit and a cassette holder according to an embodiment of the present invention.

FIG. 5 shows the details of the print unit 1 and the cassette holder 2 in the embodiment. A cassette support shaft 19, a ribbon winding motor 20, a vertical drive motor 21 for the head, and a pair of cassette motors 22 and 22' are provided on a frame 18 of the print unit 1. A rubber roller 24 is attached to a shaft 23 of the cassette motor 22. The rubber roller 24 comes in contact with the side of the cassette 9. The cassette motors 22 and 22' are rotated reversely to each other to provide thrust in the same direction for the cassette.

On the other hand, the cassette holder 2 has a construction such that cassettes are stored in four positions or portions, a position or portion ①, a portion ②, a portion ③ and a portion ④. At the four portions, a pair of cassette motors 25 having a rubber roller attached to a shaft, a pair of sensors 26 and 27 and cassette support shafts 28 are provided on an L-shaped plate 29. These motors and sensors are connected to a circuit substrate 30. With the structure and arrangement as described above, the ribbon cassette 9 can be successively replaced to effect printing. The printing is a known matter. The replacement of the ribbon cassette 9 will be described hereinbelow.

As previously mentioned, the cassette holder 2 is located along the travel path of the print unit 1. The ribbon cassette mounting position of the print unit 1 is at the same level as the height of the cassette receiving position of the cassette holder 2. Accordingly, by moving the print unit 1, the cassette mounting position of the print unit 1 can be coincided with a suitable cassette at the cassette positions ①, ②, ③, and ④ within the cassette holder 2.

FIG. 5 shows the state where the cassette receiving position 4 of the cassette holder 2 is empty and the cassette 9 is mounted on the print unit 1.

Figure 6:
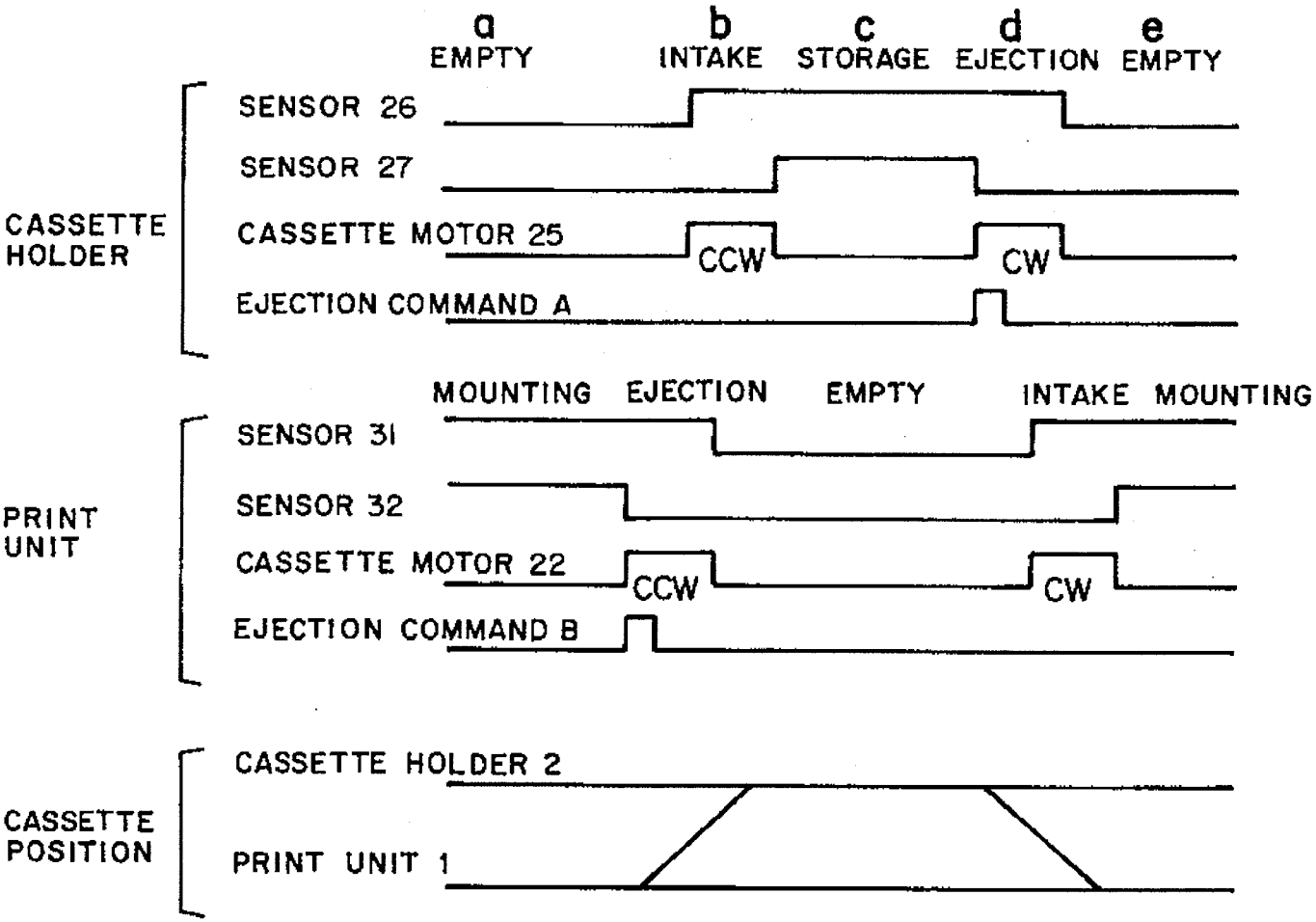
FIG. 6 is a timing chart for the exchange of a cassette according to the present invention.

The state at this time is as follows. At a portion a in a timing chart shown in FIG. 6, both the sensors 26 and 27 of the cassette holder 2 are in an OFF state, and in the print unit 1, a sensor 31 is ON and a sensor 32 is ON. Both the cassette motors 25 and 22 stop.

Next, the cassette motor 22 rotates in a direction of CCW (counterclockwise) in response to an ejection command B to start extruding the cassette 9 from the print unit 1. Then, the shield plate 16 of the cassette 9 is disengaged from the sensor 32 so that the sensor 32 is turned OFF. Further, the cassette 9 is extruded from the print unit 1, and the ribbon cores 13 and 14 are fitted onto the shafts 28 of the cassette holder 2. When the cassette 9 further advances, the shield plate 16 enters the sensor 26 so that the sensor 26 is turned ON.

When the sensor 26 is turned ON, the cassette motor 25 starts to rotate in the direction of CCW to start taking in the cassette. When the cassette 9 further advances in the direction of the cassette holder 2, the shield plate 16 of the cassette is disengaged from the sensor 31 so that the output of the sensor 31 is turned OFF. The motor 22 stops in coincidence with the end. The cassette is further pulled into the cassette holder 2 by the rotation of the cassette motor 25, the shield plate 16 of the cassette moves into the sensor 27, and the sensor 27 is turned ON. Immediately after the sensor 27 is turned ON, the cassette motor 25 stops to complete the transfer of the cassette 9 from the print unit 1 to the cassette holder 2.

A cassette of a different color is mounted on the print unit in the following manner. The print unit 1 is moved to a suitable position out of the remaining cassette receiving positions ①, ②, and ③ of the cassette holder, and the cassette 9 is transferred from the cassette holder 2 to the print unit 1 in a manner similar to the method described above. Printing is then performed, and a ribbon cassette is replaced to perform printing in a similar manner.

As described above, according to the present invention, it is possible to realize a thermal color printer capable of printing a plurality of colors using a mono-chromatic ribbon. A printer of CG display can be put to practical use.

The first embodiment of the first invention as applied to a thermal color printer has been described. Second and third embodiments of the invention will now be described.

In the color printer according to the present invention, each monochromatic ribbon cassette is selected to effect printing similarly to a multi-color offset printing and a wood print. The whole surface of a ribbon is not used without waste as in the case of a monochromatic print. Therefore, the rate of utilization of a ribbon poses a great problem in terms of running cost.

The second and third inventions solve the above-described problem. In this case, when a print signal is not present, a ribbon is not fed when not utilized, but is stopped. When the head is moved to a next printing position, a ribbon is then fed whereby the rate of utilization of the ribbon is enhanced to lower the running cost. When a print signal is not present, the head is quickly fed to a position at which a print signal is present to speed up printing.

Figure 7:
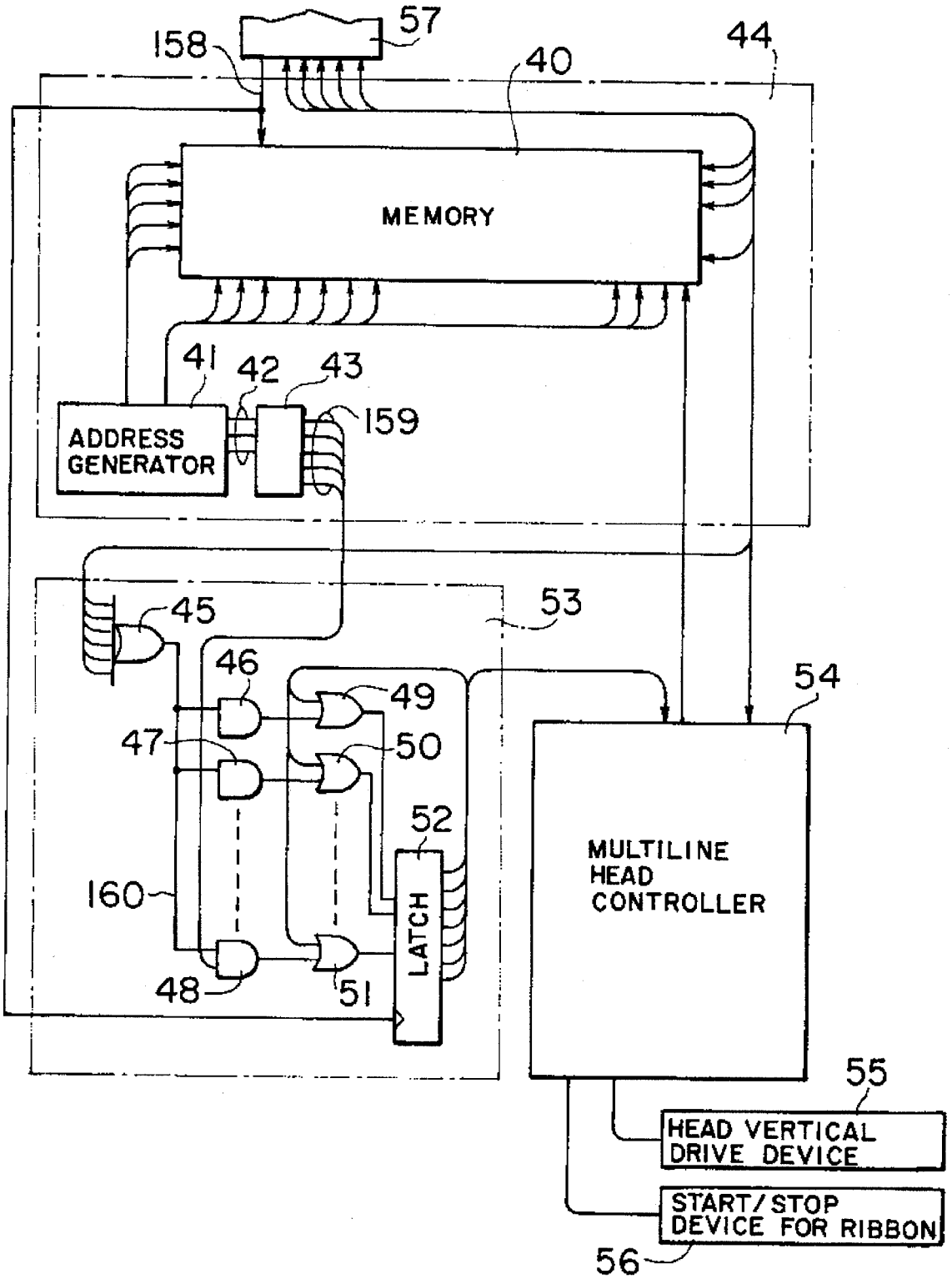
FIG. 7 is a block diagram of an embodiment of a ribbon control device according to the present invention.

FIG. 7 is a block diagram of an embodiment of a ribbon control device according to the present invention. The ribbon control device comprises an address control circuit 44 including a memory 40, an address generator circuit 41 and a decoder circuit 43 for inputting and decoding a part 42 of an address bit signal to be outputted from the address generator circuit 41, a memory circuit 53 including gates 45, 46, 47, 48, 49, 50 and 51 and a latch circuit 52 comprised of a register or a memory, and a thermal head control circuit 54. The thermal head control circuit 54 controls a head vertical drive device 55 and a start/stop device for ribbon 56.

Figure 8:
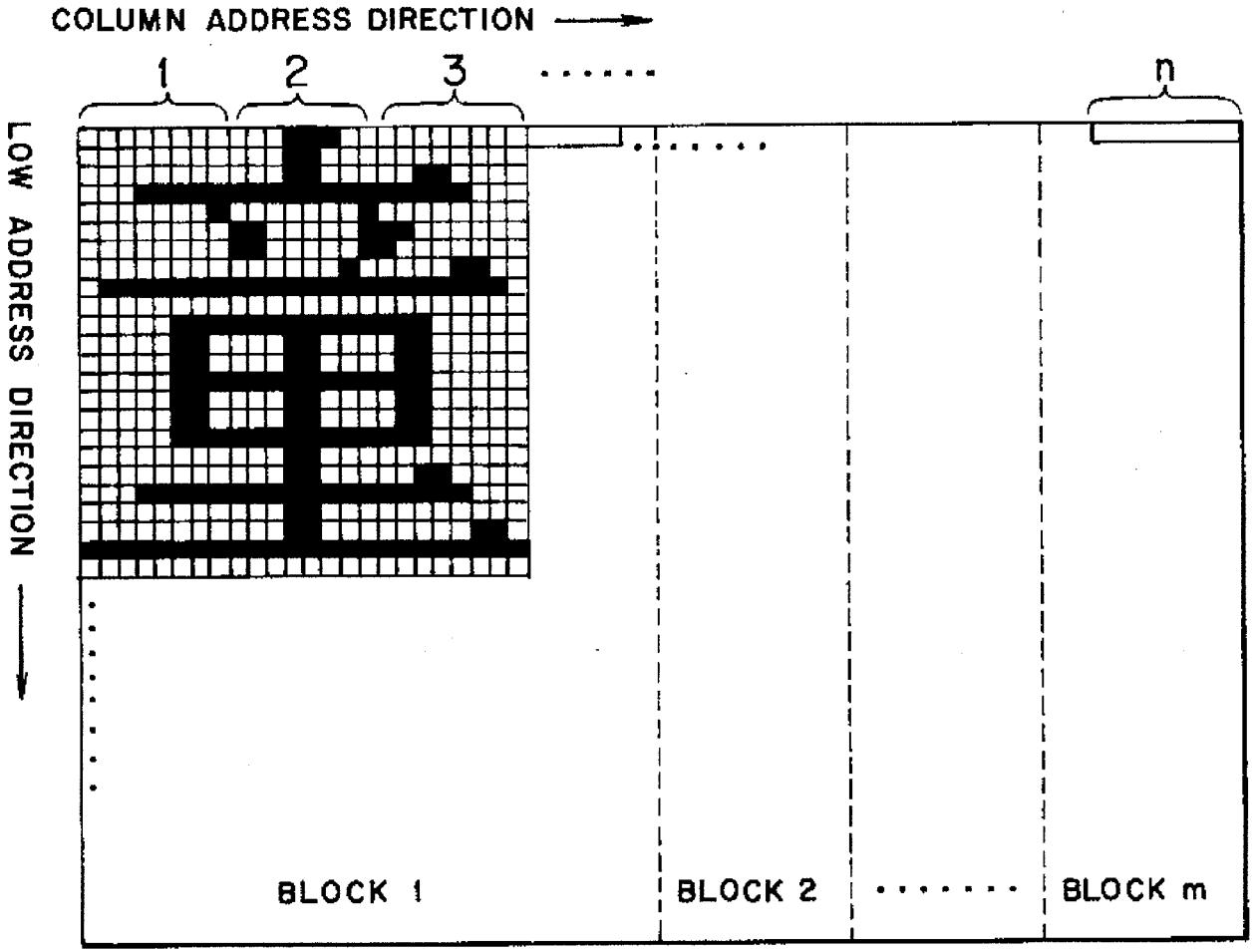
FIG. 8 is an explanatory view showing the state in which memory data is written.

First, an image print data 158 is transferred from an I/F port 57 of a host computer or a print data control board to the memory 40 in order of 1, 2, 3, 4 . . . n as shown in FIG. 8. A signal 42 of N bit is removed from a most significant bit of a column address and inputted into the decoder circuit 43 such as a demultiplexer to produce $2^N$ decode signals 159 whereby the memory is greatly formed into a block of $2^N$. Further, raster data is written into the memory 40, and at the same time an output signal 160 with OR removed by OR gate 45 of data bit is inputted into AND gates 46 to 51. The presence or absence of dot data by block is detected by a signal having AND of the output signal 60 and the decode signal 59.

The presence or absence of data is written by the latch signal into the latch circuit 52 capable of N bit latching the detected signal from the memory 40.the memory 40.

When data is once present, it is written into and latched by the latch circuit 52. Therefore, OR between AND outputs of the AND gates 46 to 48 and the latch circuit 52 is taken by OR gates 49 to 51 to maintain data.

In this manner, if a column address is counted up in the latch circuit 52, a low address is then increased, and the similar operation is again carried out.

When data is completed to be stored in the memory 40, the thermal head control circuit 54 recognizes the presence or absence of data every block through the latch circuit 52 to skip a block of a bit not containing data at the time of printing. That is, the head is fed quickly.

The construction and operation of main parts have been described. The above-described embodiment has a problem in that when a thermal head is used as a printing head, and the width of the head is wide, the printing head is moved while being pressed against paper at the time of printing, and as a result a force of the head tending to draw the paper acts so that the paper moves, so as to easily cause trouble such as deviation in the print.

Figure 9:
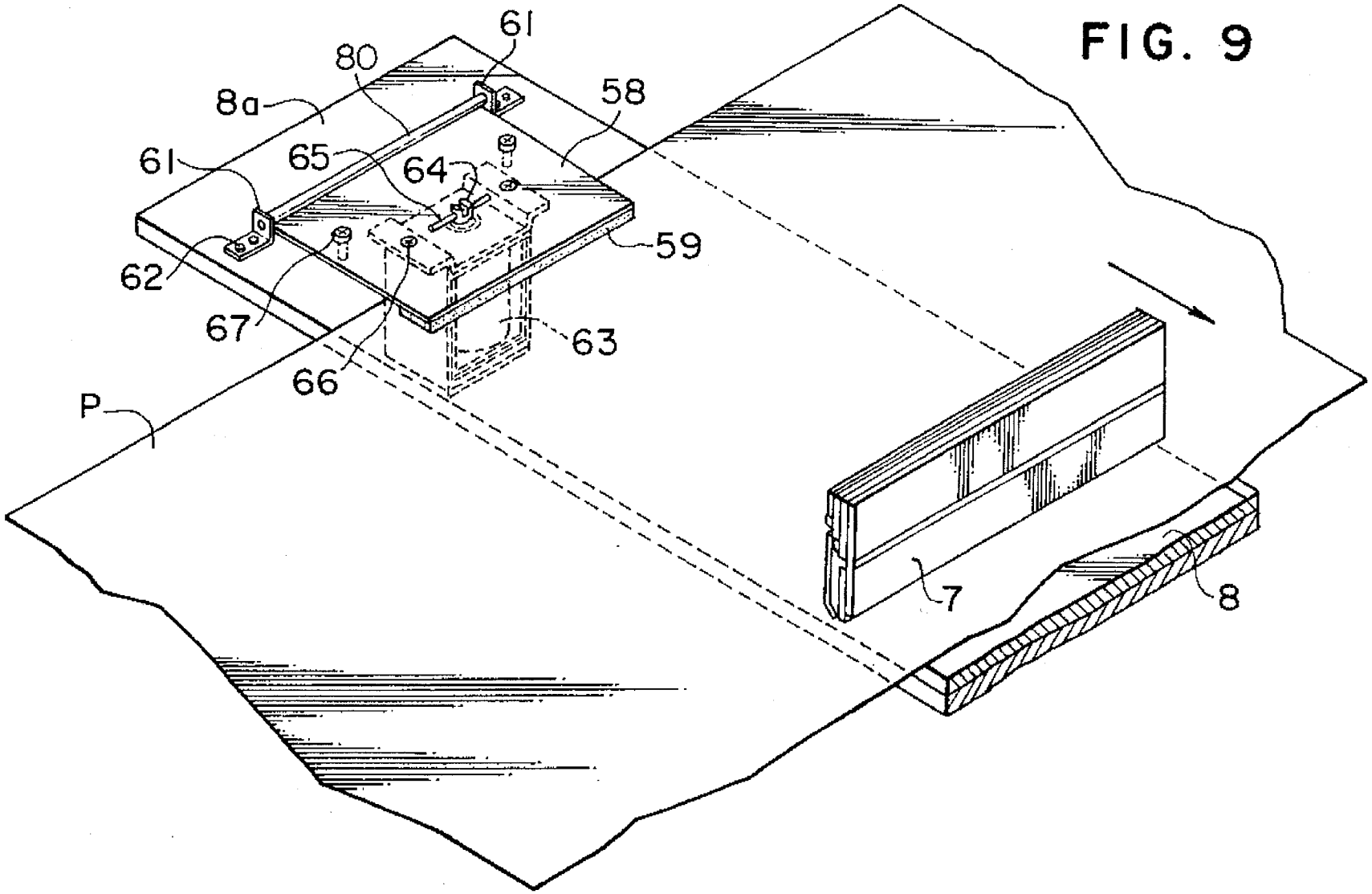
FIG. 9 is a perspective view of a paper gripping mechanism according to an embodiment of the present invention.
Figure 10:
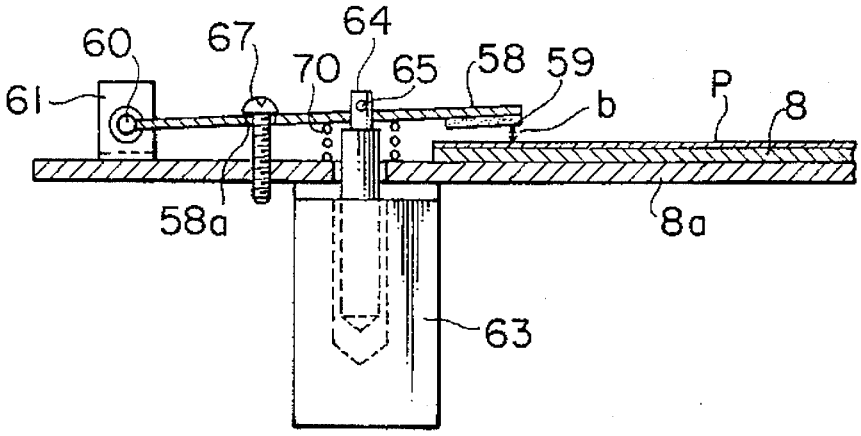
FIG. 10 is a longitudinal side view of a gripping mechanism according to an embodiment of present invention.
Figure 11:
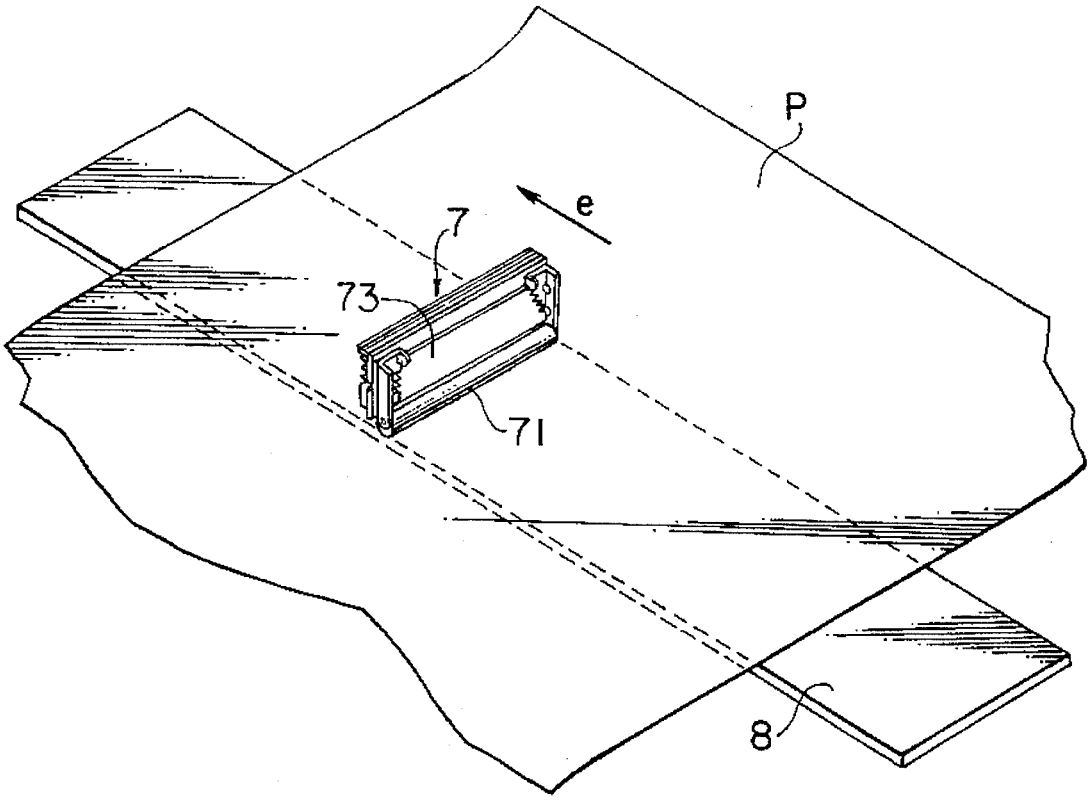
FIG. 11 is a perspective view of a thermal head with a paper keep mechanism according to an embodiment of the present invention.

In view of the foregoing, in the embodiment of the present invention a paper gripping mechanism as shown in FIGS. 9 and 10 and a paper keeping mechanism as shown in FIGS. 11 and 12 are provided to solve the above-described problem.

The paper gripping mechanism and the paper keeping mechanism will now be described with reference to the drawings.

FIG. 9 is a perspective view showing the detail of the paper gripping mechanism according to the embodiment, and FIG. 10 is a longitudinal side view showing the structure of the main part. Reference numeral 7 designates a thermal head, and P denotes paper.

Printing is performed by moving the thermal head 7 in a direction as indicated by an arrow while being placed in pressure contact with paper P, which printing is similar to other thermal printers.

A suppressive plate 58 for keeping paper P is provided on the side end at which printing of the paper starts, which suppresses the paper end during printing to fix the paper P.

A pressure contact rubber 59 is pasted to the extreme end of the suppressive plate 58, and the other end thereof is fixedly mounted on a support shaft 80. The support shaft 80 is mounted by a screw 62 on a platen plate 8a through a bearing plate 61, the support shaft 80 capable of being rotated relative to the bearing plate 61.

A stopper screw 67 is provided to keep a clearance b between the paper P and the pressure contact rubber 59 when printing is not performed. It is stopped by having the screw 67 connected to the platen plate *8a* and through a hole *58a* of the suppressive plate 58, which is larger than the screw diameter and smaller than the screw head diameter.

A plunger magnet 63 is secured by screws 66 to the platen support Ba. A plunger pin 64 is connected to the suppressive plate 58 by means of a stop pin 65. A coil spring 70 is loosely fitted on the plunger pin 64 between the suppressive plate 58 and the platen support *8a* to push up the suppressive plate 58.

Accordingly, when the plunger magnet 63 is energized, the plunger pin 64 is pulled into the plunger magnet 63, and the suppressive plate 58 is placed in pressure contact with the platen 8 through paper. This pressure contact fixes paper P to prevent the latter from being dragged by the thermal head 7. The pressure contact rubber 59 increases the frictional force to enhance the paper fixing effect.

According to the paper gripping mechanism described above, an effective paper holding force is generated by the pressing force of the suppressive plate 58 to suppress the dragging phenomenon of paper caused by the thermal head 7, which is particularly useful for a thermal printer for performing the graphic printing in which even a slight deviation of paper affects on the printing result.

Figure 12A:
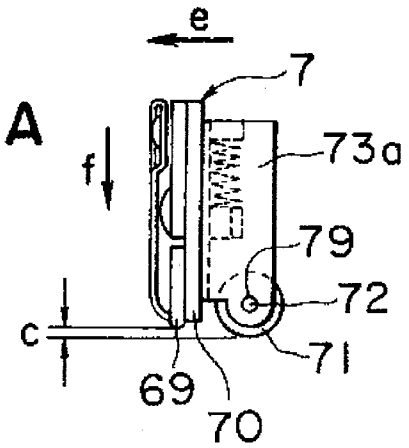
FIG. 12A is a front view of a thermal head with a paper keep mechanism according to an embodiment of the present invention.
Figure 12B:
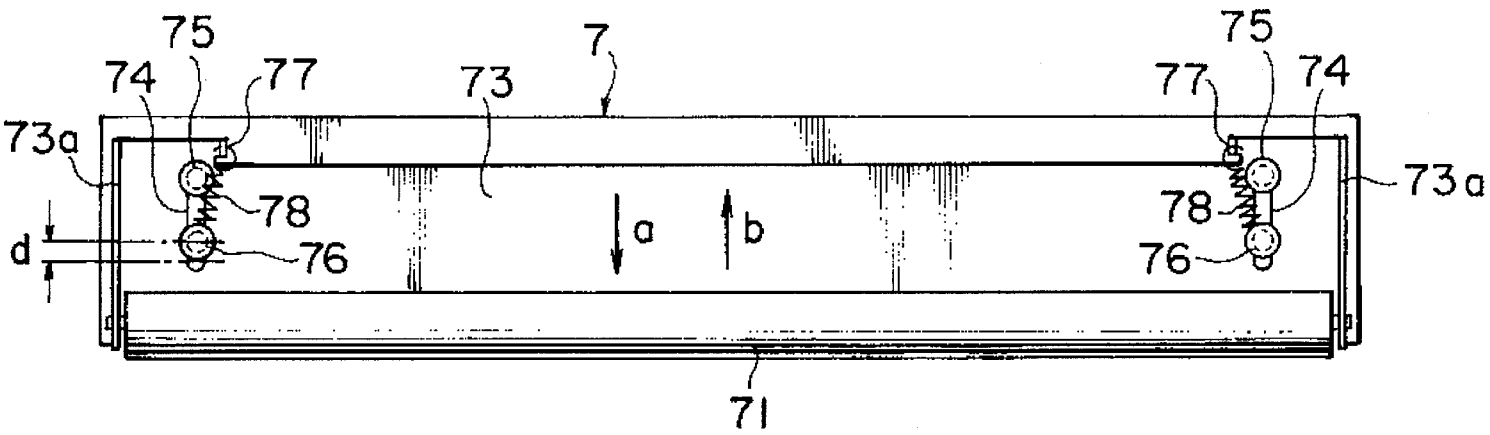
FIG. 12B is a right side view of FIG. 12A.

FIG. 11 is a perspective view of a thermal head provided with a paper keeping mechanism according to a further embodiment of the present invention. FIG. 12A is a front view, and FIG. 12B is a right side view of FIG. 12A. Reference numeral 7 designates a thermal head, 8 denotes a platen, and P denotes paper.

A slide plate 73 of the thermal head 7 is provided with two slots 74 on left and right sides. The slot 74 has shafts 75 and 76 therein so as to be slidably movable on the shafts on a heat sink 70 of the thermal head 7.

The shaft 76 is provided at its head with a groove. One end of a spring 78 is engaged with the groove, and the other end of the spring 78 is engaged with a hole 77 in a bent portion of the slide plate 73.

Brackets 73*a* are provided with respective holes 79 and formed by bending both ends of the slide plate 73. A shaft portion 72 of a pressure contact roller 71 is inserted into the holes 79 so that the former may be rotated.

A difference in level c is provided between a thermal element portion 69 of the thermal head and the pressure contact roller 71. More specifically, the pressure contact roller 71 mounted on the slide plate 73 extends downward through a length of c from the thermal element portion 69.

The slide plate 73 is always pulled in the direction of arrow a by means of the springs 78, in which state the slot 74 has room to move in the direction of arrow b by a dimension d. The relationship c<d is established. Accordingly, when the slide plate 73 is pressed in the direction of arrow f on the paper P placed on the platen 8, the slide plate 73 moves in the direction of arrow b so that the difference in level c between the thermal element portion 69 and the pressure contact roller 71 disappears. The pressure contact roller 71 presses the paper P under pressure of the springs 78.

This state is shown in FIG. 11. Printing is performed by moving the head in the direction of arrow e in the state where the thermal element portion 69 of the thermal head 7 and the pressure contact roller 71 press paper P.

The frictional force acting between the paper P and the platen 8 acts as a fixing force for the paper by the pressing pressure of the pressure contact roller 71 to prevent the paper P from being dragged by the thermal element portion 69 of the head.

The dragging force on the paper P resulting from the movement of the pressure contact roller 71 in the direction of arrow e is extremely small, since the pressure contact roller 71 rotates. Therefore, the effect of the holding force of the paper P caused by the pressure contact roller 71 is great.

As described above, according to the embodiment shown in FIGS. 11 and 12, an effective paper holding force is generated by the pressing force of the pressure contact roller 71 with respect to the paper P and the platen 8 to enable the suppression of the dragging phenomenon of paper caused by the thermal head.

The embodiments of the present invention have been described with reference to the drawings. The present invention has the actual merits in that, since a monochromatic ribbon is used, colors can be freely combined, the ink ribbon is easily manufactured, the use of the ribbon is not wasteful, and printing can be sped up.

Further, since the ribbon is automatically exchanged, if a ribbon is once set, unmanned operation can be made until printing is completed. This is particularly useful for a color printer for color computer graphics. While in this specification, an embodiment has been illustrated of the case applied to a thermal color printer which can be easily carried out, it is to be noted that the present invention can be also applied to a dot impact printer.

What is claimed is:

1. A color printer, comprising:

a print unit comprising a serial printing head extending in a paper feed direction and a ribbon cassette receiving portion;

a means for moving said print unit along a moving path in a lateral direction perpendicular to the paper feed direction;

a cassette holder for accomodating a plurality of monochromatic ribbon cassettes, said cassette holder being disposed adjacent to and parallel with the moving path of said print unit; and means for transferring a monochromatic ribbon cassette between said cassette holder and said print unit in response to a control signal.

2. The color printer of claim 1, and further comprising a means for stopping ribbon feed in a monochromatic ribbon cassette and moving said print unit to a next printing position in the absence of a print signal.

3. The color printer of claim 1, wherein said print unit comprises support shafts for holding a monochromatic ribbon cassette thereon, said cassette holder comprises a plurality of positions for receiving respective monochromatic ribbon cassettes, each of said positions comprising support shafts for holding a monochromatic ribbon cassette, and said means for transferring comprises a plurality of motors connected to respective rollers for moving monochromatic ribbon cassettes between said print unit and said cassette holder.

4. The color printer of claim 3, wherein said means for transferring further comprises a plurality of sensors on said print unit and on said cassette holder for determining the position of a monochromatic ribbon cassette.

5. A color printer, comprising:

a print unit comprising a serial printing head extending in a paper feed direction and a ribbon cassette receiving portion;

a means for moving said print unit along a moving path in a lateral direction perpendicular to the paper feed direction;

a cassette holder for accomodating a plurality of monochromatic ribbon cassettes, said cassette holder being disposed adjacent to and parallel with the moving path of said print unit;

means for transferring a monochromatic ribbon cassette between said cassette holder and said print unit in response to a control signal; and a ribbon control device comprising a memory means having a control circuit for equally dividing one scan portion of the serial head by a column address bit for raster scan image data transmitted from a one of a host computer and print data control hardware for providing a signal in a suitable memory block unit, means for detecting and holding the presence or absence of a dot to be printed having a received data width for every signal of said control circuit when data is received, and means for discriminating the presence or absence of data of said means for detecting and holding when a serial head is scanned according to a print signal, whereby when data is present, a ribbon is fed and when data is not present, the ribbon is stopped.

6. A color printer, comprising:

a print unit comprising a serial printing head extending in a paper feed direction and a ribbon cassette receiving portion;

a means for moving said print unit along a moving path in a moving direction perpendicular to the paper feed direction, said moving path having a print start end;

a cassette holder for accomodating a plurality of monochromatic ribbon cassettes, said cassette holder being disposed adjacent to and parallel with the moving path of said print unit;

means for transferring a monochromatic ribbon cassette between said cassette holder and said print unit in response to a control signal; and means for holding a paper end of paper being printed by said print unit at said print start end of said moving path of said print unit.

7. The color printer of claim 6, and further comprising a platen supported by a platen support for receiving paper to be printed on, wherein said means for holding a paper end comprises a plate pivotably mounted to one end of said platen support, said plate being movable into engagement with paper on said platen.

8. The color printer of claim 7, wherein said plate is connected to a plunger magnet for movement thereby and has a spring biasing said plate away from said platen.

9. A color printer, comprising:

a print unit comprising a serial printing head extending in a paper feed direction and a ribbon cassette receiving portion;

a means for moving said print unit along a moving path in a lateral direction perpendicular to the paper feed direction;

a cassette holder for accomodating a plurality of monochromatic ribbon cassettes, said cassette holder being disposed adjacent to and parallel with the moving path of said print unit;

means for transferring a monochromatic ribbon cassette between said cassette holder and said print unit in response to a control signal; and a roller disposed adjacent to said serial head for pressure-contacting and retreating from paper being printed together with said serial head.

10. The color printer of claim 9, wherein said roller is movably mounted to said serial head and is biased in a direction toward paper being printed.

11. The color printer of claim 10, wherein said roller is connected to a slide plate, said slide plate is movably mounted on said serial head and a pair of springs biases said slide plate relative to said serial head.

* * * * *